United States Patent [19]

Devos et al.

[11] 4,422,881

[45] Dec. 27, 1983

[54] INSTALLATION AND PROCESS FOR THE CONTINUOUS SEPARATION OF MIXTURES OF SUGARS AND/OR OF POLYOLS BY SELECTIVE ADSORPTION

[75] Inventors: Francis Devos, Hazebrouck; Didier Delobeau, Merville; Jean-Jacques Caboche, Lestrem; Patrick Lemay, Estaires; Michel Huchette, Merville, all of France

[73] Assignee: Roquette Freres, Lestrem, France

[21] Appl. No.: 201,832

[22] Filed: Oct. 29, 1980

[51] Int. Cl.[3] ..... C13D 3/14

[52] U.S. Cl. ..... 127/46.1; 127/46.2; 127/46.3; 210/264; 210/284; 210/424; 210/670

[58] Field of Search ..... 127/9, 46 A, 46.1, 46.2, 127/46.3; 210/284, 670, 264, 424

[56] References Cited

U.S. PATENT DOCUMENTS

| | | | |
|---|---|---|---|
| 3,268,605 | 8/1966 | Boyd | 210/676 |
| 3,351,488 | 11/1967 | Zievers et al. | 127/46 A |
| 3,706,812 | 12/1972 | Derosset et al. | 55/344 |
| 3,785,864 | 1/1974 | Laver et al. | 127/46 A |
| 4,157,267 | 6/1979 | Odawara et al. | 127/46.1 |
| 4,182,633 | 1/1980 | Ishikawa et al. | 127/9 |
| 4,211,579 | 7/1980 | Quentin | 127/46 A |

FOREIGN PATENT DOCUMENTS

| | | |
|---|---|---|
| 981084 | 5/1951 | France . |
| 2391754 | 12/1978 | France . |

*Primary Examiner*—Peter Chin

*Attorney, Agent, or Firm*—Larson and Taylor

[57] ABSTRACT

The invention relates to a process for continuous separation of mixtures of sugars and/or polyols. The mixture is fed to an installation comprised of at least 3 adsorbent filled columns connected in series. The columns represent absorption, enrichment and desorption zones respectively. The process provides for the continuous sequential operation of the columns as absorption, enrichment and desorption zones.

3 Claims, 2 Drawing Figures

Figure 1:
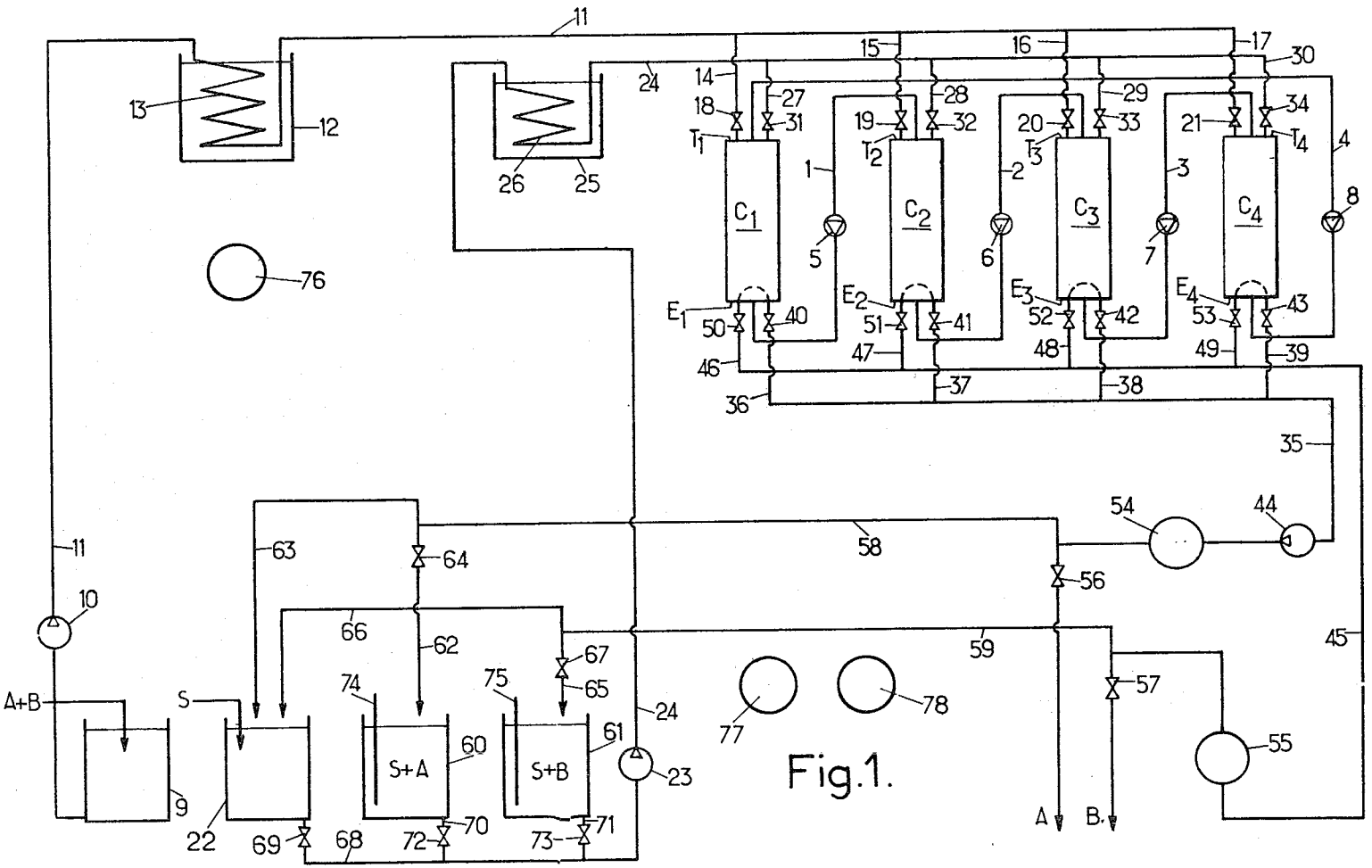

INSTALLATION AND PROCESS FOR THE CONTINUOUS SEPARATION OF MIXTURES OF SUGARS AND/OR OF POLYOLS BY SELECTIVE ADSORPTION

The invention relates to an installation and a process for the continuous separation by selective adsorption of mixtures of sugars and/or of polyols.

The installation according to the invention which comprises:

at least two columns filled with an adsorbent material and arranged in series, means for feeding each of these columns in parallel, on the one hand with a mixture of at least two constituents to be separated and, on the other hand with a solvent, means for extracting in parallel fractions each enriched in one of the constituents of the mixture to be separated and, means forming a communication between the outlet of a given column and the following column, is characterised by the fact that it comprises as many check valves as columns, these valves being arranged in the communicating means connecting each column to the following one.

According to an advantageous embodiment, the abovesaid installation is equipped with three volumetric pumps of which two achieve the feeding of the installation and are arranged respectively upstream of the means for feeding the columns in parallel with the mixture to be separated and with the solvent, the third one being arranged downstream of the means extracting in parallel the fractions enriched in one of the constituents to be separated, this constituent being preferably that of the constituents which is most strongly adsorbed within the columns.

According to another advantageous embodiment, the abovesaid installation is equipped with regulating means for the temperature adapted to impart predetermined temperatures to the mixture to be separated, on the one hand, and to the solvent, on the other hand, said means being arranged upstream of the respective feed means for feeding the columns with the mixture to be separated as well as with the solvent.

According to another advantageous embodiment, the abovesaid installation is equipped with preferably $n+1$ recycling tanks, n being the number of constituents of the mixture to be separated, said installation comprising furthermore means for feeding these tanks, these means, which are connected to the extraction means comprised by the installation, feeding the $n+1$ tanks with solvent extracted from the installation and with fractions of solvent containing at least one of the n constituents of the mixture to be separated.

According to another advantageous embodiment, the abovesaid installation is equipped with control or check means placed on the extraction pipes by which the effluents charged with one or other of the constituents of the mixture to be separated are extracted, these control means being adapted to determine the composition and the concentration of these effluents.

Advantageously, these control means are constituted by polarimeters, refractometers, densimeters and/or spectrophotometers.

The process for the continuous separation according to the invention is characterised by the fact that the installation according to the invention is used and by the fact that the constituent columns of the latter are filled with an organic adsorbent material, preferably a resin of the sulfonated polystyrene-divinylbenzene type more particularly in its calcium form.

The abovesaid separation process is, in addition, characterised by the fact that the control of the means for continuous feeding the installation with mixture to be separated and with solvent, of the means for the continuous extraction of fractions enriched in one of the constituents of the mixture to be separated, and of the means for feeding the recycling tanks, is achieved in such a way that within the adsorbent contained in the constituent columns of the installation and taken as a whole, two successive zones distinct from one another are formed, of which the first one works as an adsorption zone and the second as a desorption zone, the whole constituted by the two zones encompassing the whole of the adsorbent material and percolating cyclically through the latter.

According to an advantageous embodiment of the abovesaid process, the temperatures of the mixture to be separated and of the solvent are regulated so that at a given moment and place the adsorbent material is:

either at a relatively high temperature if the given place is at this moment in the desorption zone, or at a relatively low temperature if the given place is at this moment in the adsorption zone, the values of the relatively high temperature and those of the relatively low temperature being selected within ranges imposed respectively by the constituents to be separated and the solvent used.

The installation according to the invention has the advantage of being constructable from an existing installation which has previously operated batch-wise, by including in it the above-indicated characteristic elements.

This installation is also advantageous as the operation of the check valve placed between two successive columns is automatic and is caused by pressure drops, consequently not requiring any positive action.

This installation has a great simplicity in operation resulting from the fact that the latter is achieved by means of only three volumetric pumps of which only one, i.e. the extraction pump, permits, through its actuation, the regulation of the whole of the system, this being due to the closing of the circuit between the adsorption zone and the desorption zone.

Due to the control or check means comprised by the installation and through which the simultaneous composition of the effluents derived from the two zones (adsorption and desorption) are known continuously, it is very easy to ascertain that each given column has been perfectly desorbed before becoming the last enrichment stage of the adsorption zone. The sequential checking, column by column, enables possible misfunction of a given column to be located immediately. The checking is carried out on effluent currents at constant flow rate, constant temperature and at atmospheric pressure.

The invention will, in any case, be well understood by means of the additional disclosure which follows, with illustrative drawings relating thereto and examples, said additional disclosure and examples relating to preferred embodiments.

Figure 2:
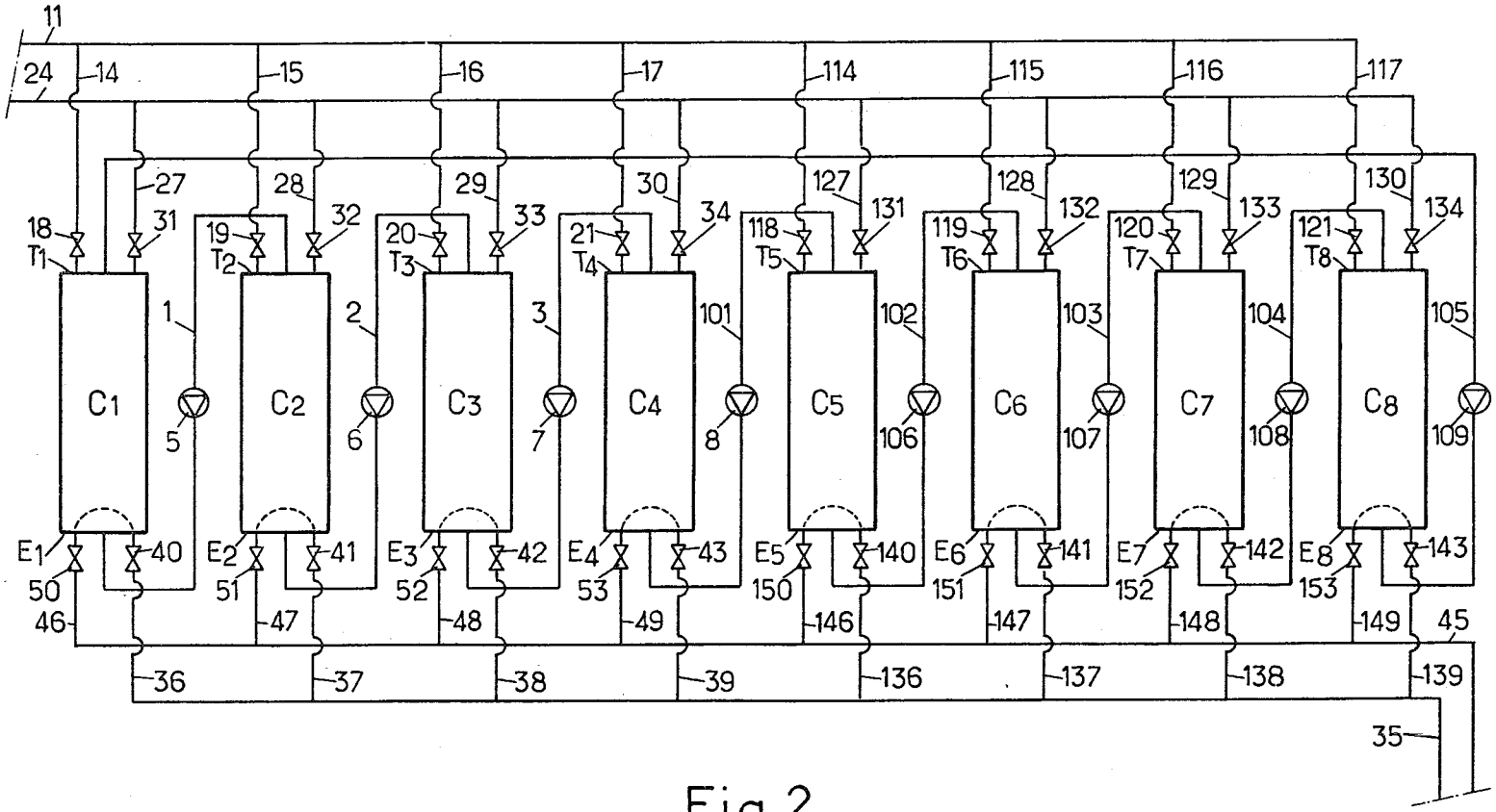

In the drawings:

FIG. 1 shows the constituent parts of an installation according to the invention, constructed according to a first preferred embodiment and FIG. 2 shows, on an enlarged scale, a part of the abovesaid installation constructed according to a second preferred embodiment.

In order firstly to separate into its constituents a mixture A+B, A being a sugar or polyol strongly adsorbed on the selected adsorbent material, recourse may be had to the installation according to the invention shown diagrammatically in FIG. 1 and which comprises four columns $C_1$ to $C_4$ connected by means, notably pipes 1, 2, 3 and 4 which connect a given column through its side or extremity corresponding to the extraction (respectively $E_1$ to $E_4$) to the side or extremity of the following column corresponding to the head of the latter (respectively $T_1$ to $T_4$), each of the pipes 1 to 4 being equipped according to the invention with a check valve respectively 5, 6, 7 and 8.

The installation is supplied or feeded with the mixture A+B to be separated drawn from a storage tank 9 by means of a first volumetric pump 10 leading the mixture through a pipe 11 which passes through regulating means for the temperature 12 constituted, for example, by a thermoregulated water bath within which the pipe 11 forms a coil 13, to the four columns to the head of which said pipe is connected in parallel by four pipes 14, 15, 16, 17, each provided with an electro-valve, respectively 18, 19, 20 and 21.

The installation is feeded with solvent drawn from a storage tank 22 supplied with fresh solvent progressively with the consumption of the latter, by means of a second volumetric pump 23 leading the solvent through a pipe 24 which passes through regulating means for the temperature 25, constituted, for example, by a thermoregulated water-bath within which the pipe 24 forms a coil 26 to the four columns to the head of which said pipe is connected in parallel by four pipes 27, 28, 29, 30 each provided with an electrovalve, respectively 31, 32, 33 and 34.

The installation comprises, to recover the fractions enriched in constituent A, first extraction means comprising a collecting pipe 35 connected in parallel by four pipes 36, 37, 38, 39 to the sides or extremities of the four columns corresponding to the extraction, these pipes being each provided with an electrovalve, i.e. respectively 40, 41, 42 and 43, a third volumetric pump 44 equipping these first extraction means, this pump being arranged downstream of the four pipes in parallel.

The installation comprises, to recover the fractions enriched in constituent B, second extraction means comprising a collecting pipe 45 connected in parallel by four pipes 46, 47, 48, 49 to the sides or extremities of the four columns corresponding to the extraction, these pipes being each provided with an electrovalve, i.e. respectively 50, 51, 52 and 53.

The volume extracted by these second means is prescribed by the difference between the volumes introduced by means of the first and second abovesaid volumetric pumps and the volume extracted by means of the third volumetric pump.

It would be possible to arrange this third volumetric pump in the pipe 45.

The pipes 35 and 45 each include a device able to analyse the concentration of the occuring effluent, especially a recording polarimeter, i.e. respectively 54 and 55.

These pipes are, in addition, each equipped with an electrovalve respectively 56 and 57 arranged downstream of the polarimeters 54 and 55.

At a point situated upstream of the electrovalves 56 and 57 and downstream of the polarimeters 54 and 55, the pipes 35 and 45 are connected by branches, respectively 58 and 59, to preferably as many recycling tanks as there are constituents in the mixture to be separated, and to a supplementary one intended for the recycling of the practically pure solvent, this supplementary tank being advantageously the one and same as the abovesaid tank 22 from which the solvent is drawn for feeding the installation.

In the present case, the installation includes therefore three recycling tanks, i.e. respectively 60, 61 and the abovesaid tank 22.

Thus the branch 58 is connected in parallel to the tank 60 and to the tank 22 by two pipes respectively 62 and 63, the tank 60 being intended for the effluents weakly charged with constituent A and the tank 22 for the practically pure recycled solvent. The pipe 62 includes an electrovalve 64.

The branch 59 is connected in parallel to the tank 61 and to the tank 22 by two pipes respectively 65 and 66, the tank 51 being intended for the effluents weakly charged with constituent B. The pipe 65 includes an electrovalve 67.

Due to the fact that the tank 22 is merged with or is one and the same as the tank intended for the recycling of the practically pure solvent, it is connected to the pump 23 through a pipe 68 provided with an electrovalve 69.

The pipe 68 includes, in addition, two pipes 70 and 71 connecting the pump 23 to the tanks 60 and 61 in parallel with the tank 22, the pipes 70 and 71 being, in addition, equipped respectively with an electrovalve, i.e. 72 and 73.

By manipulation of the opening and the closing of the electrovalves 56 and 57, on the one hand, and of the electrovalves 64 and 67, on the other hand, either fractions enriched in constituents A or B are recovered, or fractions weakly charged with these constituents are recycled.

The recycling of these weakly charged fractions is controlled by level detectors 74 and 75 respectively equipping the tanks 60 and 61.

The recycling is carried out with the supply of solvent to the installation, it being stressed however that, preferably, the fraction weakly charged with constituent B is introduced into a given column before the introduction of an amount of pure solvent, the fraction weakly charged with constituent A being introduced after the introduction of a quantity of pure solvent.

The installation comprises, in addition:

a first device of the timer type shown at 76 and servo-coupling the opening and closing of the supply and extraction electrovalves, i.e. 18, 19, 20, 21, 31, 32, 33, 34, 40, 41, 42, 43, 50, 51, 52 and 53;

a second device of the timer type shown at 77 and servo-coupling electrovalves 56 and 64, the level detectors 74 and 75 and the electrovalves 69, 72 and 73;

a third device of the timer type shown at 78 and servo-coupling electrovalves 57 and 67, the level detectors 74 and 75 and the electrovalves 69, 72 and 73.

The regulation of the timers can be carried out according to data supplied by the polarimeters on the composition of the fractions extracted.

If, in the mixture to be separated, the constituent A is only adsorbed on the adsorbent material to an average extent, the constituent B being, as previously, "excluded", recourse to a four column installation as has just been described may prove insufficient in so far as the recorded results are concerned and it is then preferable to resort to an installation with a greater number of columns.

In FIG. 2, is shown, on a larger scale, the part of the installation of FIG. 1 relating to the columns; in the disclosed embodiment, the installation comprises eight columns. Certain parts of the installation of FIG. 1 are not shown in FIG. 2 for lack of space. In any case, apart from the "part encompassing the columns" the installations according to FIGS. 1 and 2 are identical.

The constituent elements common to these installations are given the same reference numerals.

The following description is therefore limited to the additional elements included by the installation of FIG. 2.

The latter includes four additional columns $C_5$, $C_6$, $C_7$ and $C_8$.

The column $C_5$ is connected to the column $C_4$ through a pipe 101, the columns $C_5$ to $C_8$ are connected together by pipes 102, 103, 104 and the column $C_8$ is connected to the column $C_1$ through a pipe 105.

The pipes 102 to 105 are individually equipped with check valves 106, 107, 108 and 109.

The sides or extremities of columns $C_5$ to $C_8$ corresponding to the feeding are marked by $T_5$, $T_6$, $T_7$ and $T_8$, those corresponding to the extraction by $E_5$, $E_6$, $E_7$ and $E_8$.

The columns $C_5$ to $C_8$ are connected in parallel to the pipe 11 through pipes 114, 115, 116 and 117 respectively equipped with electrovalves 118, 119, 120 and 121.

They are connected in parallel to the pipe 24 by pipes 127, 128, 129 and 130 respectively equipped with electrovalves 131, 132, 133 and 134.

They are connected to the collecting pipe 35 in parallel by pipes 136, 137, 138 and 139 respectively equipped with electrovalves 140, 141, 142 and 143 and to the collecting pipe 45 in parallel by pipes 146, 147, 148 and 149 equipped respectively with electrovalves 150, 151, 152 and 153.

From a general point of view, it is underlined that the ratio height/diameter of the columns equipping the installation is selected between 3 and 0.3, preferably between 2 and 0.5.

In accordance with the process according to the invention, the columns are filled with an organic adsorbent material.

Preferably, the adsorbent material is a resin of the sulfonated polystyrene-divinylbenzene type, especially in its calcium form.

The particle size distribution of the resin employed is advantageously from 0.1 to 3 mm, preferably from 0.2 to 1 mm.

The servo-coupling of the opening and the closing of the electrovalves ensuring the continuous supply of the installation with the mixture to be separated, with solvent and with recycled fractions as well as the continuous extraction of fractions enriched with solvent and of weakly charged fraction which are directed to the recycling tanks, is effected so that, by means of timer type devices, within the adsorbent contained in the constituent columns of the installation and taken as a whole, there are formed two successive zones distinct from one another, of which the first functions as an adsorption zone and the second as a desorption zone, the whole constituted by the two zones encompassing the totality of the adsorbent material and percolating through the latter cyclically.

From a practical point of view, at a given moment, the opening of four electrovalves relating respectively to a supply of product to be separated, a supply of solvent, an extraction of the strongly adsorbed constituent A and an extraction of constituent B, is carried out.

By means of water-baths 12 and 25 respectively, the temperature of the mixture to be separated and of the solvent is regulated so that at a given moment and place the adsorbent material is:

either at a relatively high temperature provided that the given place is at this moment in the desorption zone, or at a relatively low temperature provided that the given place is at this moment in the adsorption zone.

The values of the relatively high temperature as well as those of the relatively low temperature are selected within ranges prescribed respectively by the constituents to be separated and the solvent used.

The illustration of these ranges of temperature will appear from the examples.

To draw a maximum advantage from this regulation of the temperature, it is preferable to heat-insulate the columns which are advantageously selected among those which have a filtering base or bottom.

In a large number of cases, the solvent is constituted by water.

The following explanation will show the effects of the various steps indicated above, this explanation being made by means of the description of the operation of the two above-described installations.

The first case considered is that of the separation of the mixture A+B in which constituent A is strongly adsorbed and the constitutent B excluded, the object of the separation being to obtain fractions moderately enriched in constituent A as well as fractions highly enriched in constituent B.

It is assumed that the installation adopted for this separation is that of FIG. 1, at a given moment at which the column $C_1$, which is charged with constituent A, is treated with solvent consequent upon the opening of the electrovalve 31 and that the column $C_2$, which is desorbed, is charged with mixture A+B by opening of the electrovalve 19.

Parallel with the opening of the electrovalves 31 and 19, the electrovalves 53 of the column $C_4$ and 40 of the column $C_1$ are open.

The introduction of the solvent on the column $C_1$ is manifested by the desorption of the latter and the extraction of the constituent A through the pipe 35.

The introduction on the column $C_2$ of the mixture t be separated A+B is manifested by the adsorption of a part of A and by the displacement of the contents of this column to the column $C_3$ by passing through the pipe 2. Within the column $C_3$ an additional impoverishment of the syrup in constituent A occurs and a displacement of the contents of this column to the column $C_4$ within which the syrup coming from the column $C_3$ abandons the remainder of the constituent A and displaces the solvent contained therein enriched in constituent B.

The thus defined cycle is ended when the desorption of the column $C_1$ is complete, the timer 76 then operating the closing of the previously considered electrovalves and the opening of a new set of electrovalves ensuring the conveyance of the mixture to be separated A+B to the column $C_3$ consequent upon the opening of the electrovalve 20 and the desorption of the column $C_2$ by the opening of the electrovalve 32.

There then occurs a group of displacement phenomena similar to those which have just been described and which lead to the outflow of an effluent enriched in constituent B through the electrovalve 50 which is open and to the outflow of an effluent moderately enriched in constituent A through the electrovalve 41 of the column $C_2$ which is then open.

Here again, the cycle is ended when the desorption of the column $C_2$ is accomplished and, at this moment, the timer actuates a further operation of the closing of the set of electrovalves which have just been kept open and the opening of a new set of electrovalves.

The cycle thus repeats continuously.

If it is desired to obtain, not effluents enriched in constituent B and weakly enriched in constituent A, but enriched by a value which is not high, comparable for the two constituents, the operation of the installation is modified so that, in the first cycle in which the desorption is operated on column $C_1$ by opening of the electrovalve 31, the supply with mixture to be separated A+B is ensured on the column $C_3$ by opening of the electrovalve 20.

Then, effluents enriched in constituent A are extracted from column $C_1$ by opening of the electrovalve 40 and in effluents enriched in constituent B are extracted from the column $C_4$ by opening of the electrovalve 43. After complete desorption of the column $C_1$, the cycle is terminated and the timer 76 actuates the changing of electrovalves so that, in the subsequent cycle the desorption occurs on column $C_2$ by introduction of solvent, the mixture A+B being feeded to the column $C_4$.

During this second cycle, the extraction of effluents enriched in constituent A is carried out on column $C_2$ and the extraction of effluents enriched in constituent B on column $C_1$.

As has already been explained above, the four column installations of the type whose operation has just been described, become insufficient when the constituent A of the mixture to be separated A+B is only averagely adsorbed on the adsorbent material, or when it is desired to carry out a high enrichment simultaneously of constituent A and of constituent B.

An additional number of columns then becomes indispensable and, to illustrate an installation capable to separate such a mixture, recourse may be had to that of FIG. 2 which includes eight columns arranged in series.

The operation of such an installation to separate such a mixture is as follows.

To have again the two well separated working zones, in this particular case with eight columns, it is necessary, by means of the timer 76, to carry out at a given moment the opening of four electrovalves ensuring the supplies with the mixture to be separated and with water and the extractions of the products excluded and adsorbed.

The check valve located immediately upstream of the desorption zone will achieve perfectly the non-contamination of the product excluded by the eluant and will dictate the direction of the chromatographic current.

In this manner of operation, the mixture to be separated is feeded to a column of the adsorption zone other than the first one; the degree of enrichment produced will be a consequence of the selection of this column.

This is effected, for example, at a given moment by the opening of the electrovalves 18 and 131 respectively ensuring the supplies with the mixture to be separated and with water, and by the opening of the electrovalves 53 and 140 ensuring respectively the outflows of the excluded and of the adsorbed products.

All the other supply and extraction electrovalves are then closed and due to this arrangement, the installation works for a given time fixed by the timer 76, with a four stage adsorption zone (columns $C_1$ to $C_4$), a three stage enrichment zone (columns $C_6$-$C_7$-$C_8$) and a one stage desorption zone (column $C_5$).

The commutation step of one stage which is carried out to accompany the chromatographic front and which concerns the installation as a whole is fixed at n minutes (every n minutes, the opening of the four electrovalves move by one position downstream); consequently, for the following n minutes, the opening of the electrovalves 19 and 132, on the one hand, and 150 and 141, on the other hand, is actuated.

EXAMPLE 1

Separation of glucose and frustose mixtures

It is known that starch hydrolysates must have a fructose content at least equal to 50% to have a sweetening power at least equal to that of invert sugar.

Techniques enabling the isomerisation of the glucose into fructose by the enzymatic route are now well estalished, but the biochemical kinetics and the economic conditions of use of glucose-isomerase have the result that starch hydrolysates obtained in this manner only titrate, after isomerisation, about 42% of fructose.

An object is consequently to otain from these hydrolysates, a fraction in which the fructose content has been brought from 42% to, for example, 60%.

In this case, the other component, the glucose, is refined to the maximum.

To do this, recourse is had to the installation shown in FIG. 1 (the four constituent columns have an effective volume of 15 liters for a height of 40 cm and a diameter of 22 cm); the fructose plays the role of constituent A, and the glucose that of B. Three columns are intended for the glucose enrichment (the product which is desired to be obtained with a high degree of purity) and only one column for the fructose desportion (it is desired to collect this product with high dry matter, but with a richness of only 60%). It will be noted that, in this case, the introduction into the system of the mixture to be separated (A+B) is done at the head of the adsorption zone.

It is hence on the corresponding column that the dry matter is highest. This column becomes a desorption zone at the following cycle; consequently, this column will then give a syrup enriched in fructose with high dry matter.

At a given movement, this is effected by the opening of the electrovalves 31 and 19 ensuring respectively the supplies of columns $C_1$ with water and $C_2$ with isomerised syrup and of the electrovalves 53 and 40 ensuring respectively the outlets of non-adsorbed product B (glucose) and adsorbed product A (fructose).

The check valve 8 then prevents the outflow of the solvent through the electrovalve 53, obliging the solvent to pass through $C_1$. All the other feed and outflow electrovalves are closed during this phase.

The temperature of the desorption water (water-bath 25) is fixed at 85° C., that of the isomerised syrup (water-bath 12) at 60° C.

The amount of isomerised syrup feeded on a given column is determined by the capacity of the adsorbent to fix the amount of fructose which would be necessary for obtaining a syrup with 60% richness.

The amount of eluant introduced is that necessary for the complete desugaring of the column operating in desorption.

These two amounts are hence fixed by the nature of the product to be enriched and by the volumes of adsorbent available in each column.

The time for which the electrovalves 31 and 19 remain open (they are then replaced by the electrovalves 32 and 20) is hence fixed by the amounts of isomerised syrup and of eluant taking into account the fluid flow rates compatible with the pressure drop requirements of the installation and compatible with the adsorption and desorption speeds.

These conditions are well fulfilled, in this case, by feeding amounts of:

5 liters of isomerised syrup at 500 g/l per column, 11 liters of water at 85° C. per column.

A water flow rate of 44 liters/hour causing throughout the installation a pressure drop equal to 500 grams may be selected as average value. The "passage time" of the timer (commutation of the supply from two given columns to the two following columns) can thus be fifteen minutes, the water flow rate thus being 44 liters/-hour, this taking into account the fact that 11 liters of water will desugar the column operating in desorption.

The flow rate of isomerised syrup will be 20 liters/-hour: every fifteen minutes, 5 liters of isomerised syrup will thus be distributed to a given column.

This isomerised syrup (mixture A+B to be separated) has the following composition:

42% of fructose

52% of glucose

6% of polysaccharides.

Calculation shows that the ratio with which a syrup 60% rich in fructose is extracted from a syrup at 42%, is 63%, this extraction providing furthermore a by-product with 10% of fructose. In other words, 100 kg of isomerised syrup at 42% of fructose provide 63 kg of syrup with 60% of fructose and 37 kg of syrup rich in gluclose containing 10% of fructose.

The installation is consequently conducted in such a way that the extraction pump 44 provides an extraction flow enriched in fructose representing 63% of the input dry matter.

Under these conditions:

"Passage time": 15 minutes

Flow rate of isomerised syrup with 500 g/l: 20 liters/h

Flow rate of elution water: 44 liters/h.

The extraction flow rates are:

Glucose rich fraction: 24.6 liters/hour

Fructose rich fraction: 39.4 liters/hour.

The dry matter of the fractions rich in glucose is 150 g/liter on the average and it is 160 g/liter for the fractions rich in fructose.

EXAMPLE 2

After 48 hours of stable operation under the conditions of Example 1, the recycling tanks of the installation were used in the manner described below.

The timer 78 was adjusted to recycle the solvent during the first 7 minutes, then during the 3 following minutes to take out of the circuit the part of the glucose fraction containing particularly the polysaccharides, and lastly to extract through the electrovalve 57 from the 10$^{th}$ to the 15$^{th}$ minute the highly enriched glucose intended to be brought back to the isomerisation installation. The timer 77 was adjusted to take out through the electrovalve 56 the fructose during the first 10 minutes, then to recycle the following fractions to the tank 60 from the 10$^{th}$ to the 15$^{th}$ minute, these fractions having to serve primarily for the desugaring of the following cycle.

Under these conditions, the following richnesses, flow rates and dry matter contents were obtained:

fraction containing 60% of fructose: 26.3 l/h at 240 g/l

Glucose-polysaccharides mixture containing 40% of polysaccharides: 4.9 l/h at 200 g/l Glucose rich fraction by recycling to isomerisation (containing 7% of polysaccharides): 8.2 l/h at 330 g/l.

Gas chromatography shows that the fructose fraction contains less than 1% of polysaccharides.

EXAMPLE 3

Production of pure sorbitol from a hydrogenated starch Hydrolysate

After hydrogenation, this hydrolysate contained 94% of true sorbitol and 6% of hydrogenated polyholosides.

In this case, the sorbitol was adsorbed and played the role of constitutent A, the polyholosides playing that of constituent B.

In this case, the object was to remove an adsorbed product with a richness of about 100%. The setting of the electrovalves was modified with respect to Example 1 so as to feed the syrup to be separated to the head of the second column of the adsoprtion zone.

Thus the syrup supply, at a given time T, is effected by opening the electovalve 20, the elution water is lead in through the electrovalve 31, the excluded hydrogenated polysaccharides flow out through the electrovalve 52 and the pure sorbitol through the electrovalve 40.

In the following cycle, the electrovalves 21, 32, 50 and 41 are open, all the others being closed.

The temperature of the syrup is 40° C. and that of the water 80° C.

The feed flow rates were as follows:

Hydrogenated hydrolysate with 50% dry matter: 13.8 l/hour

Water: 41.2 l/hour.

The extraction flow rates were:

Pure sorbitol: 22.8 l/hour

Hydrogenated polyholosides: 32.2 l/hour.

The passage or commutation of the feeds and of the extractions from one group of columns to the following one is effected by the timer 76 every 22 minutes.

After 15 hours of operation, the sorbitol outflow titrated 265 g/l of sorbitol with 99% of richness, the hydrogenated polyholosides outflow titrated 53 g/l at 70% of sorbitol.

EXAMPLE 4

Manufacture of syrups with a high maltose content

A starch liquefied by a bacterial alpha-amylase up to a D.E. of 18 was then subjected for 48 hours to the action of a beta-amylase until the production of a D.E. of 48.

The syrup obtained, purified according to the usual techniques titrated a dry matter of 50% and had the following composition:

Maltose: 52%

Dextrose: 5%

Maltotriose: 20%

Polysaccharides (DP>3): 23%.

This syrup was treated in the installation according to FIG. 1, with an electrovalve setting identical with that of Example 3.

The elution water had a temperature of 85° C. and the syrup a temperature of 40° C.

The flow rates were:

Syrup supply at 500 g/l: 13 l/hour

Water supply: 39 l/hour.

The passage of commutation time of the electrovalves was fixed at 20 minutes.

At extraction flow rates of 33 liters/hour of fractions enriched in polysaccharides and of 19 liters/hour of fractions enriched in maltose, an average dry matter of 60 g/liter was obtained for the fractions enriched in polysaccharides and a dry matter of 240 g/l for the fraction enriched in maltose.

The respective compositions of these fractions were as follows:

Enriched maltose
- 68% maltose
- 7% dextrose
- 22% maltotriose
- 3% polysaccharides Polysaccharides
- dextrose: traces
- maltose: 15%
- maltotriose: 15%
- dextrins: 70%

EXAMPLE 5

The preceding Examples show that, to obtain with a high purity one of the two products of a mixture A+B, the four columns installation is sufficient.

However, to obtain a more extensive refining of the two outflows, it is possible to use an eight columns installation such as that shown in FIG. 2.

Using this installation whose operation has been described above, procedure was as follows.

The product to be separated was an isomerised syrup having the following composition:

Percentage of soluble matter: 45%

Fructose: 47%

Dextrose: 50%

Polyholosides: 3%.

The temperatures were set at 80° C. for the elution water and at 60° C. for the mixture to be separated. The passage or commutation time selected for the electrovalves was 18 minutes.

The volumetric pumps were adjusted so as to ensure:

as regards the feeds:

Isomerised syrup at 45%: 7.2 liters/hour

Water flow rate: 41.7 liters/hour as regards the extractions:

Dextrose outflow: 34.2 liters/hour

Fructose outflow: 14.7 liters/hour.

After 48 hours of steady operation (see also the description of the operation of the installation given above), the effluents extracted were analysed every two minutes during a complete cycle of 18 minutes.

The results are recorded in Table I below.

TABLE I

| Time (minutes) | Fructose outflow Soluble matter g/liter | Fructose outflow αD | Dextrose outflow Soluble matter g/liter | Dextrose outflow αD |
|---|---|---|---|---|
| 2 | 295 | −87°5 | — | |
| 4 | 244 | −90° | — | |

TABLE I-continued

| Time (minutes) | Fructose outflow Soluble matter g/liter | Fructose outflow αD | Dextrose outflow Soluble matter g/liter | Dextrose outflow αD |
|---|---|---|---|---|
| 6 | 176 | −90° | — | |
| 8 | 116 | −90°5 | — | |
| 10 | 66 | −91° | 20 | +67°5 |
| 12 | 40 | −91° | 60 | +57°5 |
| 14 | 15 | — | 124 | +42° |
| 16 | — | | 190 | +37° |
| 18 | — | | 240 | +30° |

After 72 hours of operation, analysis of the effluent extracts again followed, for two minutes intervals through a complete cycle and the results are collected in Table II.

TABLE II

| Time (minutes) | Fructose outflow Soluble matter g/liter | Fructose outflow αD | Dextrose outflow Soluble matter g/liter | Dextrose outflow αD |
|---|---|---|---|---|
| 2 | 295 | −87°3 | — | |
| 4 | 260 | −90° | — | |
| 6 | 205 | −90° | — | |
| 8 | 136 | −90° | — | |
| 10 | 80 | −91° | 25 | +65° |
| 12 | 45 | −92° | 65 | +58° |
| 14 | 20 | — | 130 | +47°5 |
| 16 | — | | 180 | +40° |
| 18 | — | | 230 | +35° |

It is demonstrated by the data recorded for αD that the richness in the average fructose fraction is higher than 98%, this value being confirmed by gas chromatography.

It is shown by the data recorded for αD that the richness in dextrose in the dextrose fraction is higher than 90%; this fraction contains all the polyholosides.

EXAMPLE 6

The installation of the preceding Example was used and the recycling means employed.

The electrovalves 57, 67, 56, 64, 69, 72, 73 for the recovery of the weakly charged solvent were put into service by timers 77 and 78 so as to recover, on the one hand, the strongly adsorbed product, i.e. the fructose, through A during 12 minutes, then the solvent excess from the 12$^{th}$ to the 18$^{th}$ minute to the tank 60 and, on the other hand, to recover the dextrose outflow water excess during the first 11 minutes to the tank 61 and then the dextrose from the 11$^{th}$ to the 18$^{th}$ minute through B.

In this way, the amount of water necessary for desugaring the desorption zone (these recovery waters being deducted) could be reduced to 15.9 liters/hour.

Under these conditions, there were extracted: an effluent charged with dextrose of 13.3 l/hour at 139 g/liter an affluent charged with fructose of 9.8 l/hour at 177 g/liter.

The richness in fructose was higher than 98%. This fraction was practically free of polyholosides.

The richness in dextrose was 90%.

EXAMPLE 7

This experience was carried out along the manner indicated in Example 6.

The isomerised syrup was introduced into the installation with a proportion of dry matter of 500 g/l.

Under these conditions, there were extracted:

an effluent charged with dextrose at 145 grams/liter an effluent charged with fructose at 185 grams/liter.

The richnesses in dextrose and in fructose were the same as in Example 6.

EXAMPLE 8

This test was carried out in the manner indicated in the preceding Example. The isomerised syrup was introduced into the installation at the flow rate of 7.2 liters/hour, but with a proportion of soluble matter of 550 grams/kg.

At richnesses equal to the preceding experiences there were extracted:

a dextrose fraction at 165 grams/liter a fructose fraction at 205 grams/liter.

The invention is in no way limited to those of its types of application and embodiments which have been more especially envisaged; it encompasses, on the contrary, all modifications.

We claim:

1. A process for the continuous separation by selective adsorption of mixtures of sugars and/or polyols which comprises initiating successive feeding/extraction sequences $S_1$, $S_2$, $S_3$, the first sequence $S_1$ comprising:

feeding the said mixture to an installation comprised of at least three columns each filled with adsorbent material, said installation of columns making up an adsorbent zone containing elution solvent, an enrichment zone, and a desorption zone, means successively communicating the outlet or extraction side of each zone with the inlet or top or head of the following one, closure means being located in the means communicating each zone with the following one, closing the closure means located directly upstream the desorption zone to prevent communication between the adsorption zone and the desorption zone and opening the other closure means, continuously feeding to the adsorption zone the mixture to be separated comprising at least a first more adsorbed and a second less adsorbed sugar or polyol, said feeding of the mixture displacing elution solvent in said adsorption zone, continuously feeding elution solvent to said desorption zone and continuously withdrawing from the bottom of said desorption zone, the first more adsorbed sugar or polyol of said mixture in said elution solvent, simultaneously, extracting from the adsorption zone the elution solvent during a first part of the sequence until the elution solvent is substantially displaced and then withdrawing the second less adsorbed sugar or polyol fom said adsorption zone during a second part of the $S_1$ sequence.

initiating a second sequence feeding/extraction ($S_2$) comprising closing the closure means in the means communicating the previous desorption and enrichment zone and opening the other closure means whereby the desorption zone of sequence $S_1$ becomes the adsorption zone to which is fed the mixture to be separated, the enrichment zone of sequence $S_1$ becomes the desorption zone to which is fed the elution solvent and the adsorption zone of sequence $S_1$ becomes the enrichment zone, thus repeating the feeding and extraction steps recited above utilizing the newly designated zones to initiate a third sequence $S_3$ and so on.

2. Process according to claim 1, comprising selecting a resin of the sulfonated polystyrene-divinylbenzene type to constitute the adsorbent material.

3. Process according to claim 1, comprising selecting a resin of the sulfonated polystyrene-divinylbenzene type in its calcium form to constitute the adsorbent material.

* * * * *